United States Patent [19]

Spanier et al.

[11] 4,294,308

[45] Oct. 13, 1981

[54] METHOD AND ASSEMBLY FOR CAMOUFLAGING AT LEAST ONE BUILDING

[76] Inventors: Joseph Spanier; Florence Spanier, both of 27 Indian Rock Ct., San Anselmo, Calif. 94960

[21] Appl. No.: 10,889

[22] Filed: Feb. 9, 1979

[51] Int. Cl.[3] ..... F24H 3/00; B64F 1/00

[52] U.S. Cl. ..... 165/1; 165/47; 52/169.5; 89/36 Z; 135/5 R; 244/114 B; 343/18 E; 428/919

[58] Field of Search ..... 244/114 B, 114 R; 343/18 B, 18 E; 428/919; 102/105; 89/362; 52/169; 165/1, 47; 135/5 R

[56] References Cited

U.S. PATENT DOCUMENTS

| | | | |
|---|---|---|---|
| 3,226,063 | 12/1965 | Wagner | 244/114 B |
| 3,858,371 | 1/1975 | Averill | 52/169.5 |
| 4,021,974 | 5/1977 | Edwards | 428/919 |

FOREIGN PATENT DOCUMENTS

| | | | |
|---|---|---|---|
| 2252431 | 5/1974 | Fed. Rep. of Germany | 428/919 |

OTHER PUBLICATIONS

"Infrared Challenges Radar's Monopoly", Aviation Week, vol. 66, No. 9, Mar. 4, 1957, pp. 50–54, 57, 59 and 61.

"Cooling of Vehicle Exhaust to Reduce Infrared Detection", USAMC Lead Laboratory for Camouflage Technology FY74 Program Summary.

*Primary Examiner*—Albert W. Davis
*Assistant Examiner*—Margaret A. Focarino
*Attorney, Agent, or Firm*—Flehr, Hohbach, Test

[57] ABSTRACT

A method of camouflaging at least one surface of at least one building is disclosed herein and utilizes an elongated support bar of nonlinear and preferably also nonsymmetrical configuration. This support bar is fixedly maintained along the length of and to one side of the surface to be camouflaged and is provided for supporting a net having a topside including artificial garnish supported thereon and a bottomside which, also includes artificial garnish in a preferred embodiment. This net is attached to the elongated support bar along an edge which conforms in configuration to the bar and extends over the surface to be camouflaged with its top garnish supporting side exposed to the surroundings.

7 Claims, 7 Drawing Figures

METHOD AND ASSEMBLY FOR CAMOUFLAGING AT LEAST ONE BUILDING

BACKGROUND OF THE INVENTION

The present invention relates generally to the art of camouflaging and more particularly to a method and assembly for camouflaging at least one surface of at least one building and especially for camouflaging a number of buildings in the same climatic area regardless of changes in season.

There are probably a number of different ways to camouflage a building, especially as viewed from an overhead airplane. Typically this is accomplished manually by providing some sort of support means, for example a net over sections of the building and placing some sort of garnish thereon. As will be seen hereinafter, the present invention provides a particular way of accomplishing this, specifically one which is economical, uncomplicated and most important reliable. Moreover, the method and assembly to be disclosed herein are especially suitable for camouflaging a jet airplane hangar while, at the same time, allowing the airplane to take off from within the hangar.

SUMMARY OF THE INVENTION AND OBJECTS

One object of the present invention is to provide an uncomplicated, economical and reliable technique (both method and assembly) for camouflaging a building, especially an airplane hangar.

Another object of the present invention is to provide a camouflage technique which takes into account seasonal changes.

Still another object of the present invention is to provide a camouflage technique which is compatible with an airplane hangar designed to allow the airplane to initially take off from within the hangar.

Yet another object of the present invention is to provide a camouflage technique particularly suitable for a jet hangar designed to allow a jet to initially take off from within the hangar without making the hangar an obvious target for infrared detection devices.

In accordance with one technique to be described in detail hereinafter, an elongated support bar of nonlinear configuration is utilized, one which is also nonsymmetrical in a preferred embodiment. As stated previously, this support bar is fixedly held in place along the length of and to one side of the given area to be camouflaged and is provided for supporting a sheet-like means, preferably a net, having a topside including artificial garnish supported thereon and a bottomside. This sheet-like means includes one edge which conforms to the configuration of the support bar and which is attached thereto. The sheet-like means extends over the surface to be camouflaged with its top garnish supporting side exposed to the surroundings.

In a preferred embodiment of the present invention, as will be seen, at least two buildings in the same climatic area are camouflaged, each utilizing its own nonlinear, non-symmetric support bar which is the mirror image in configuration of the other. Moreover, each sheet-like means includes artificial garnish on its bottomside which is different in appearance than the garnish on the topside. More specifically, the garnish on the topside of each sheet-like means provides a particular appearance which blends with the surroundings during one season while the garnish on the bottomside provides a particular appearance which blends with the surroundings during another season. In this way, sheet-like means associated with two buildings can be turned over and switched back and forth between the two buildings from one season to the next and still properly conform to the support bars, as will be explained in more detail hereinafter.

DETAILED DESCRIPTION

Figure 1:
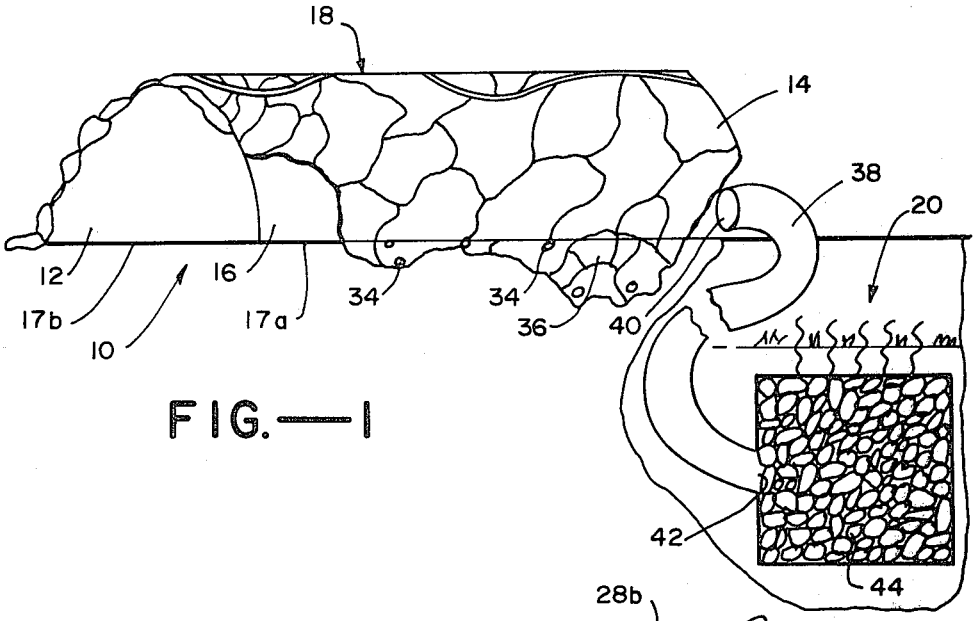
FIG. 1 is a perspective view of a building, specifically a jet airplane hangar, which has been camouflaged in accordance with the present invention.

Turning now to the drawings, wherein like components are designated by like reference numerals throughout the various figures, attention is first directed to FIG. 1 which shows an airplane hangar generally designated by the reference numeral 10. As seen in this figure, hangar 10 is semicylindrical in configuration, which is quite typical, and includes a front end 12, a back end 14, both of which may or may not include doors and a continuous top surface 16 extending from the ground on one side **17*a* of the hangar to the ground on its other side 17*b*. As will be seen hereinafter, this continuous surface is camouflaged from the air by a camouflage assembly 18 designed in accordance with the present invention. As will also be seen, when hangar 10 is used for housing jet airplanes, a second assembly 20 designed in accordance with the present invention may be provided for diverting to a remote, subterranean location the hot exhaust gasses from the jet in the event the latter is started up within the hangar. This reduces the possibility of detecting the exact location of the hangar by infrared detecting devices. Still another assembly not shown in FIG. 1 but which is illustrated in and will be discussed with respect to FIGS. 4, 5, and 6, may be provided for camouflaging both the front and back ends of hangar 10. However, as will be seen hereinafter, this latter assembly is especially designed in accordance with the present invention for camouflaging end 12** of the hangar in a way which allows rapid access into and out of the hangar by the airplane.

Figure 2A:
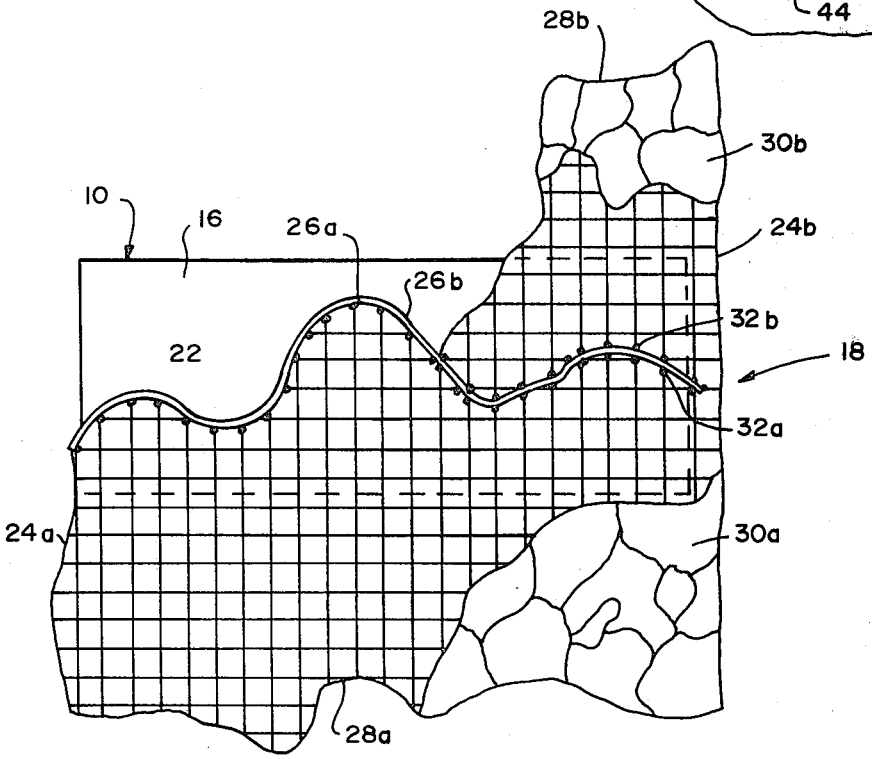
FIG. 2A is a top plan view illustrating a camouflage assembly shown in FIG. 1, specifically one used to camouflage the top and sides of the hangar.

Turning to FIG. 2A attention is now directed specifically to camouflage assembly 18. This assembly includes an elongated support bar 22 which is constructed of steel or other rigid material. As seen in FIG. 2A, this support bar is nonlinear and nonsymmetrical in configuration. It is sufficiently long to extend the length of hangar 10 from front end 12 to back end 14 and, in fact, is preferably slightly longer than the hangar. Assembly 18 also includes two nets 24*a* and 24*b* which lengthwise extend from one end of support bar 22 to its other end. Net 24*a* includes an inner edge 26*a* which conforms to the configuration of support bar 22 on one side thereof and net 24*b* includes an inner edge 26*b* which also conforms to support bar 22, on the opposite side thereof. The outer edges 28*a* and 28*b* of these nets may be straight but a preferred embodiment they are of random, nonlinear and nonsymmetrical configurations and different from one another, as seen in FIG. 2A.

As will be seen below, nets 24*a* and 24*b* serve to support artificial garnish which is carefully selected to camouflage topside 16 from the air. Accordingly, the overall span between outer edges 28*a* and 28*b* of the two nets must be long enough to cover topside 16 from the ground along one edge 17*a* to the ground along its opposite edge 17*b*. In this regard, as will be seen, the combined extent of these two nets between their outer edges is preferably greater than the widthwise span of topside 16 between ground edges 17*a* and 17*b*. In this way, outer net edges 28*a* and 28*b* lie on the ground beyond the hangar as seen in FIG. 1. The overall width of each net from its outer edge to its inner edge may or may not be equal to one another, depending on where the support bar 22 is located widthwise on topside 16. If the support bar is centrally located with respect to the ground edges of the hangar, then the two nets may be substantially identical in width (disregarding the nonlinearity of their edges). On the other hand, if the support bar is to be placed closer to one ground edge than the other, then the width of one net may be significantly less than the other.

As stated above, each of the nets 24 serves to support garnish selected to camouflage topside 16 from the air. As seen in FIG. 2A, net 24*a* supports garnish generally indicated at 30*a* on its topside and net 24*b* supports garnish generally indicated at 30*b* on its topside. While not shown, the garnish extends the entire length and width of each net and may be readily selected by those skilled in the art. In most cases, the garnish will take the form of artificial versions of plant life which grows naturally in the immediate surroundings of hangar 10. Examples of such plant life include Boston ivy, English ivy, New Zealand spinach, grapevines and sections of larger trees, shrubs and bushes such as bamboo, eucalyptus, acacia, genita, and so on. This garnish is affixed to the topside of each net using conventional fastening means such as staples, wiring or the like.

Having described camouflage assembly 18, at least partially, attention is now directed to the way in which it is assembled to camouflage topside 16 of hangar 10. At the outset, support bar 22 is welded or otherwise fixedly connected to topside 16 in the position shown in FIG. 2A. In this regard, while the support bar is shown directly between ground edges 17*a* and 17*b*, it could be positioned closer to one ground edge than the other, as stated previously. In any event, once the support bar is fixedly placed in position, the inner side edges 26*a* and 26*b* of the two nets 24 are secured in position to the opposite sides of the support bar, conforming therewith as also seen in FIG. 2A. In this regard, assembly 18 includes suitable fasteners 32*a* and 32*b* for attaching edges 26 to the support bar. These fasteners can take the form of hooks, rings or the like fixedly attached to the support bar along its length or to the inner edges of nets 24. Moreover, the nets themselves may already include garnish 30 before being attached to the support bar or the garnish can be provided thereafter. In either case, once inner edges 26 have been attached to the elongated support bar, outer edges 28*a* and 28*b* are preferably fixedly held to the ground by means of stakes 34 or other suitable means, as seen in FIG. 1.

As stated previously, in a preferred embodiment of the present invention, the overall width of the two nets 24 from outer edge 28*a* to outer edge 28*b* is longer than the width-wise span between the bottomside edges of topside 16. In this way, the outer edge can be located out beyond the ground edges 17 of the hangar so as to better blend with the surroundings. Under the circumstances, it may be desirable to also stake down the nets along lines directly adjacent the ground edges of the hangar, as shown in FIG. 1. Moreover, it may be desirable to place some sort of object or objects under this outwardly extending portion of the net, as indicated generally at 36 in FIG. 1 so as to provide a three-dimensional effect which may better serve to camouflage the hangar. Similar objects may also be placed between the two nets and the topside 16 for the same purpose.

Assembly 18 has been described as used in camouflaging the topside of a conventional semicylindrical airplane hangar. It should be apparent however that this assembly in and by itself or with slight modifications to the dimensions of support bar 22 and garnish support nets 24 could be utilized to camouflage other building surfaces or, in fact, other three-dimensional objects. Moreover, while this assembly has been described as using nets 24 for supporting garnish 30, it should be quite apparent that these nets could be readily replaced with other suitable sheet-like means so long as they are capable of supporting the garnish and can be readily attached to the support bar in the manner described. Nevertheless, nets are preferred since they can be designed to be relatively strong at a relatively low weight and because they can be readily attached to support bar 22 and they can easily support the previously described garnish.

As state previously, hangar 10 is especially suitable for housing jet airplanes which may be taking off from directly within the hangar. In doing this however the hot exhaust gasses from the jet build up within the hangar unless diverted elsewhere. This buildup of gasses is an obvious source of infrared radiation which could be easily spotted by suitable infrared detecting devices, especially from the air, thereby indicating the exact position of the hangar. As stated previously, assembly 20 reduces this possibility by diverting the gasses to a remote subterranean location. In order to accomplish this, assembly 20 includes a thermal insulated tubing 38 having a forwardmost end 40 and a rearwardmost end 42, as seen in FIG. 1. End 40 is fixedly located in a position within hangar 10 near its back end so as to capture the exhaust gasses from the jet plane as the latter begins to take off. The back end 42 is embedded within an infrared heat sink 44 in the form of gravel or other such means adapted to absorb the heat from the exhaust gasses thereby creating an infrared decoy while readily allowing the gasses to pass into the ambient surroundings. As seen in FIG. 1, pipe 38 passes directly from hangar 10 underground and thereafter to the heat sink which is also located underground. In this way, the pipe itself does not require too high of an insulation value since the earth above it will provide additional insulation and the pipe will not be spotted from above.

Figure 2B:
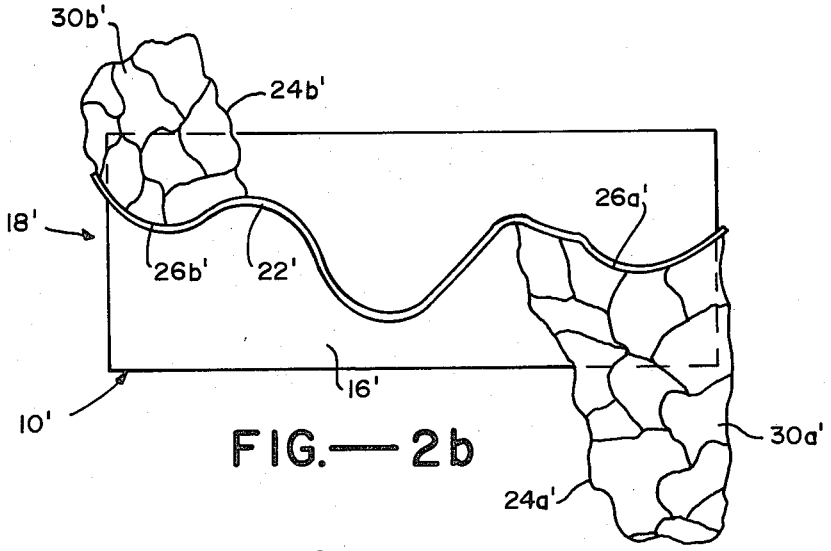
FIG. 2B is a top plan view of a second camouflage assembly which is different than the first assembly depicted in FIGS. 1 and 2A but which is used in conjunction with this first assembly in an overall system for camouflaging two hangars located in the same climatic area.

Having described camouflage assembly 18 and exhaust gas diverting assembly 20, attention is directed to the preferred way in which assembly 18 may be used in areas which have two distinct climatic seasonings and at least two hangars, the hangar 10 illustrated in FIG. 2A and a second hangar 10' shown in FIG. 2B. In this case, previously described camouflage assembly 18 includes garnish fixedly supported to the underside of net 24*a* and also to the underside of net 24*b*. This garnish may be identical to the previously described garnish 30*a* and 30*b* with one exception. The garnish 30*a* and 30*b* on the topsides of nets 24 are selected to provide a particular appearance which blends with the surroundings during one season and the garnish on the underside of these nets are designed to provide a different particular appearance which blends with the surroundings during the second different season.

The topside 16' of hangar 10' is camouflaged by an assembly 18' which, with two exceptions to be discussed below, is identical to assembly 18. Accordingly, like assembly 18, assembly 18' includes an elongated support bar 22' of nonlinear, nonsymmetrical configuration and two garnish supporting nets 24*a'* and 24*b'* attached to support bar 22' in the manner described with respect to assembly 18. This support bar 22' is fixedly connected across the topside of hangar 10' in the same manner described with respect to assembly 18 and the (2) nets which support garnish 30*a*40 and 30*b'* on their topsides and seasonally different garnish on their bottomsides are draped over and cover the adjacent surface of topside 16' in the manner previously described.

The first difference between assembly 18' and assembly 18 is that the two support bars are not of the same configuration which, of course, should be obvious from FIGS. 2A and 2B. However, it may not be as obvious that the support bar 22' is the mirror image of support bar 22 in configuration. The only other necessary difference between these two assemblies is that the inner edges 26*a'* and 26*b'* of the nets 24' conform to the configuration of the support bar 22' rather than support bar 22. These differences between the two assemblies are the result of the changes in seasons discussed previously. More specificially, during one climatic season, assemblies 18 and 18' are arranged to camouflage the topsides of the two hangars 10 and 10' in the manner shown, assuming the two hangars are in the same climatic area. As stated previously, the garnish 30 and 30' are selected to reflect that particular season. However, at the onset of the next season, it is necessary to reverse the garnish supported nets so that the underside garnish of each is exposed since, as also stated previously, this latter garnish is selected to reflect this latter season.

Figure 3:
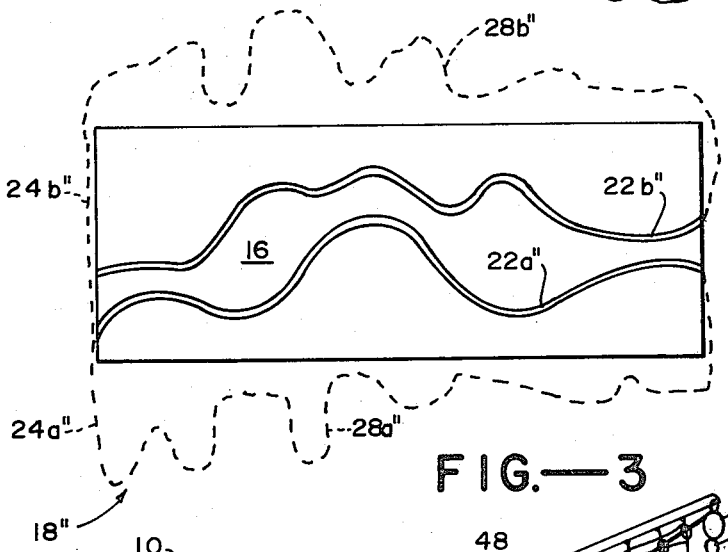
FIG. 3 is a top plan view illustrating still another camouflage assembly designed in accordance with the present invention.

In order to reverse the sides of nets 24 and 24' without turning over, replacing or otherwise moving the elongated support bars 24 and 24', the latter are specifically designed to be mirror images of each other, as stated previously. As the first step in this reversal process, the garnish supporting nets are detached from their respective support bars and turned over so that the garnish on their undersides are exposed from overhead. Thereafter, the inner edges 26*a* and 26*b* of the garnish supporting nets 24*a* and 24 *b* are attached to the elongated support bar 22', the inner edge 26*a* replacing the previously recited inner edge 26*b'* and the inner edge 26*b* replacing the previously recited inner edge 26*a'*. This is only possible because the two elongated support bars are the mirror images of one another as are the inner edges 26 and 26'. In a similar manner, the two garnish supporting nets 24*a'* and 24*b'* are turned over and their inner edges are attached to the appropriate sides of support bar 22. In this way, it is possible to provide nonlinear, nonsymmetrical support bars while at the same time being able to turn over the garnish supporting nets without requiring new support bars or even moving the old ones. Obviously, this rather sophisticated approach requiring two separate assemblies would not always be necessary if the elongated support bars were linear or at least symmetrical. However, it is this nonlinear, nonsymmetrical configuration which enhances the overall camouflaging effect of the assemblies. Having described camouflage assembly 18' and the way in which this assembly embodiment differs from and cooperates with the previously described assembly 18, attention is now directed to still another camouflage assembly 18''. This latter assembly is only slightly different than either of the previously described assemblies but is also provided for camouflaging the topside 16 (or 16') of the hangar 10 (or 10'). Unlike the previously described assemblies, assembly 18'' includes two separate elongated support bars 22*a''* and 22*b''*. These support bars are both nonlinear and nonsymmetrical in configuration but as seen in FIG. 3 they differ from one another. Both are mounted to the topside 16 of hangar 10 in the same manner as previously described support bar 22 and are spaced from one another a slight distance. The support bar 22*a''* serves to hold the inner edge of a garnish supporting net 24*a''* (indicated by dotted lines) while elongated bar 22*b''* serves to hold the inner edge of a garnish supporting net 24*b''* (also indicated by dotted lines). These two nets are draped over the topside 16 and have their outer edges 28*a''* and 28*b''* staked to the ground in the same manner as the previously described garnish supporting nets 24*a* and 24*b*. Actually the only difference between assembly 18'' and assembly 18 is that the former uses two support bars rather than one and a nonlinear, nonsymmetrical space exposing the topside 16 results from the use of assembly 18'' whereas such a space does result from the use of assembly 18. Obviously, at first glance, it would appear that assembly 18 is preferred since this assembly utilizes less components and may be more easily provided. However, it has been found that the assembly 18'' because of its greater irregularity serves to more reliably camouflage topside 16.

With all of the camouflage assemblies thus far described, it would be possible to camouflage the front and back ends 12 and 14 of hangar 10. This could be accomplished merely by extending their garnish supporting nets lengthwise a sufficient distance beyond the ends of the hangar so as to fold over and cover those ends. As an alternative, separate garnish supporting nets could be provided and draped over the ends of the hangar and these nets could be readily attached in place by fixing them to the existing garnish supporting nets 24, 24' or 24'', depending on which assembly is being used. However, it may be necessary to gain rather rapid access into or out of the hangar, for example during takeoff of the jet airplane from within the hangar. In this case, a separate assembly to accomplish this may be provided for camouflaging one end of the hangar, for example the front end.

Figure 4:
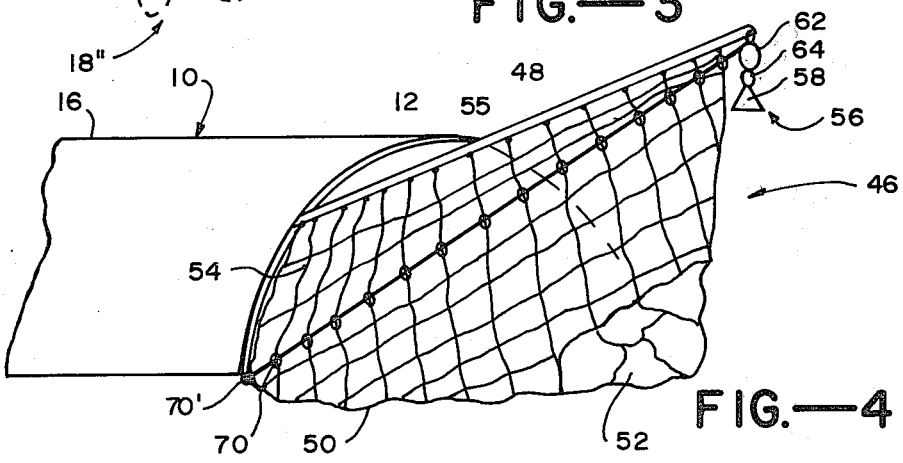
FIG. 4 is a perspective view illustrating the front end of the hangar shown in FIG. 1 and the way in which this front end is camouflaged by yet another assembly designed in accordance with the present invention.
Figure 5:
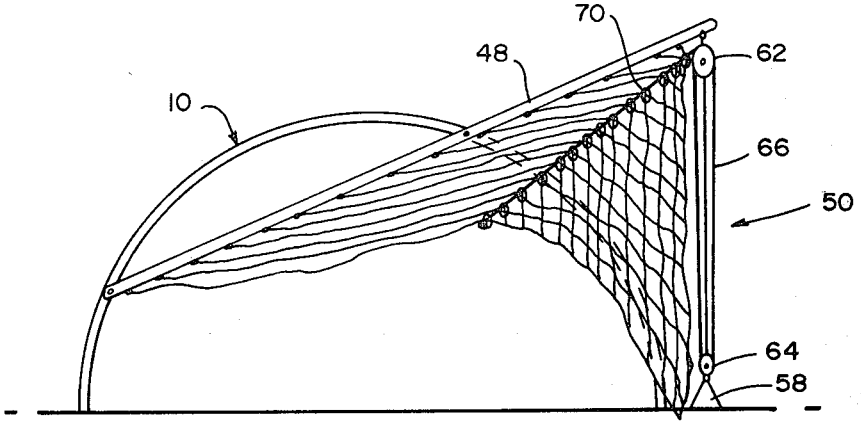
FIG. 5 is a front elevational view of the hangar shown in FIG. 4, specifically illustrating the way the camouflage assembly shown in FIG. 4 is positioned to provide access into the hangar.

An assembly capable of accomplishing rapid access into and, more important, out of the hangar is illustrated in FIGS. 4 and 5 and generally designated by the reference numeral 46. This assembly includes a fixed support rod 48 which may be nonlinear and nonsymmetrical but which may also be straight as shown. This support rod is bolted or otherwise fixedly connected to the front end of hangar 10 just below its topmost edge and extends upwardly and to one side of the hangar at an angle with the horizontal, for example at angle of about 30°. Assembly 46 also includes a net 50 supporting artificial garnish 52 on its front side. This garnish supporting net may be identical structurally to the previously described garnish supporting nets and is attached at its uppermost edge 54 to and along the length of support bar 48 by suitable fasteners 55 which may be identical to the previously described fasteners 32. As illustrated in FIG. 4, with garnish supporting net 50 attached to support bar 48 in this manner, it drapes down most of front end 12 for covering and camouflaging the latter.

Figure 6:
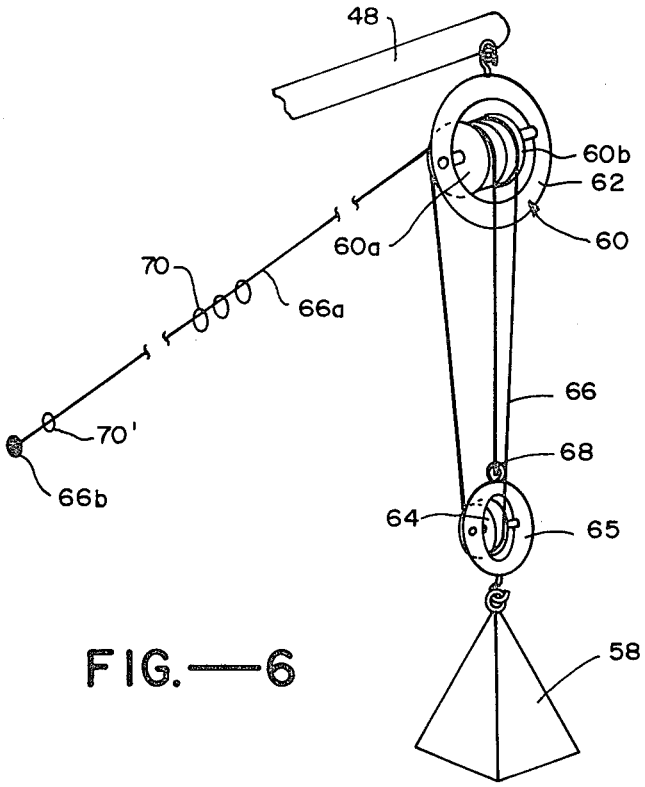
FIG. 6 is a perspective view of a counterweight arrangement comprising part of the assembly of FIGS. 4 and 5 and utilized to move the latter between its closed position (FIG. 4) and its opened position (FIG. 5).

In order to gain access into or out of hangar 10 through its front end, assembly 46 includes a counterweight arrangement 56 which is best shown, at least in part, in FIG. 6. This assembly includes a counterweight 58, a fixed dual pulley 60 mounted for rotation on a ring 62 which is in turn fixedly connected to the uppermost end of support bar 48 and a single pulley 64 mounted for rotation in a ring 65. The counterweight is attached to this latter ring. The pulley arrangement also includes a continuous rope 66 which is fixedly tied at one end to a suitable fastening clip 68 attached to the top end of pulley ring 65. This rope extends from clip 68 over one side of the dual pulley 60, specifically side **60*a* and thereafter down and under pulley 64. From pulley 64, rope 66 passes over the second side pulley 60, specifically side 60*b* and finally across the front face of garnish bearing net 50 a slight distance below the support rod 48, as best seen in FIG. 4. This latter section of the rope 66*a* is attached to net 50 by passing it through spaced fastener rings generally indicated at 70 which are attached to the net. These rings are sufficiently large to allow section 66*a* to slide therethrough. However the free end of this section is knotted at 66*b* so as not to pass through end ring 70'**.

The pulley arrangement as described serves to move the garnish bearing net 50 between the closed position illustrated in FIG. 4 and the open position shown in FIG. 5. With the net in its closed position, the counterweight 58 is in close proximity to the fixed support ring 62 and pulley 60, as best seen in FIG. 6. At the same time, section **66*a* of rope 66 extends entirely across the front end of hangar 10 along with the garnish supporting net. In order to maintain this positional configuration, it is necessary to maintain counterweight 58 in this elevated position. A suitable rope (not shown) separate from pulley rope 66 and tied to the counterweight and possibly the support bar 48 may be provided for this purpose. On the other hand, a rigid member may be fixedly connected to the hangar and positioned to extend directly below and against the underside of the counterweight when the latter is in its elevated position. In either case, once the counterweight is freed so as to fall by the force of gravity, it will do so, pulling the fastener bearing section of rope 66 and end ring 70' up towards but stopping short of fixed ring 62. This in trun draws the net up toward the fixed ring as illustrated in FIG. 5** and hence provides access through the front end of the hangar. In an actual working embodiment, the front end of the hangar can be opened in fifteen seconds using a counterweight of three hundred pounds which, because of the pulley configuration as shown, generates a one hundred pound pull.

What is claimed is:

1. In a technique for camouflaging a building containing a heat generating apparatus therein, an arrangement for preventing discovery of said building as a result of the heat generated by said apparatus, said arrangement comprising means including a passageway for diverting said heat from said apparatus within said building to a remote location, said passageway extending from said building to said remote location, at least a substantial section of said passageway being thermally insulated sufficient to prevent heat within said passageway section generated by said apparatus from being detected above ground level.

2. An arrangement according to claim 1 wherein said passageway section is below ground.

3. An arrangement according to claim 2 wherein said heat generating apparatus is a jet airplane, the exhaust gases of which provide said heat and wherein said thermally insulated means includes a thermally insulated tube for providing said passageway, said tube extending from within said building to said remote location and having one end positioned within said building to capture and thereby divert said exhaust gases.

4. An arrangement according to claim 1 including heat sink means located at said remote location for absorbing the heat diverted thereto, said absorbed heat being readily detectable by an infrared detecting device whereby to serve as an infrared decoy for said building.

5. An assembly for camouflaging at least one surface of a building containing a heat generating apparatus, comprising an elongated support bar including a number of non-linear sections which curve in different ways to provide a non-symmetrical appearance, means for supporting said bar along the length of and adjacent to a given surface to be camouflaged, sheet-like means having a topside including artificial garnish supported thereon, a bottomside, and an elongated edge displaying substantially the same non-symmetrical configuration as said support bar, means for attaching the elongated edge of said sheet-like means to said support bar such that said sheet-like means extends over said given surface with its top garnish supporting side exposed to the surrounding and means including an underground passageway for diverting the heat from said apparatus to a remote location said underground passageway extending from said building to said remote location, at least a substantial section of said passageway being thermally insulated from ground level to prevent sufficient heat within said passageway section generated by said apparatus from being detected above ground.

6. An assembly for camouflaging at least one surface of an airplane hangar especially suitable for jet airplanes, comprising an elongated support bar of nonlinear, nonsymmetrical configuration, means for supporting said bar along the length of and to one side of a given surface to be camouflaged, sheet-like means having a topside including artificial garnish supported thereon, a bottomside, and an elongated edge having the same nonlinear, nonsymmetrical configuration as said support bar and means for attaching the elongated edge of said sheet-like means to said support bar such that said sheet-like means extends over said given surface with its top garnish supporting side exposed to the surrounding, a second elongated support bar of nonlinear, nonsymmetrical configuration different than the configuration of said first mentioned support bar, second means for supporting said second bar along the length of and to one side of a second given area to be camouflaged, second sheet-like means having a topside including artificial garnish supported thereon, a bottomside and an elongated edge having the same nonlinear, nonsymmetrical configuration as said second support bar, means for attaching the elongated edge of said second sheet-like means to said second support bar such that said second sheet-like means extends over said second surface with its top garnish supporting side exposed to the surrounding, and means located adjacent the back end of the hangar for diverting the heated exhaust gases of a jet starting up in said hangar to a subterranean location spaced a substantial predetermined distance from said hangar and heat sink means positioned at said location for absorbing the heat from said diverted exhaust gases.

7. A method of camouflaging at least one surface of a hangar especially suitable for housing jet airplanes, comprising the steps of supporting an elongated support bar of nonlinear, nonsymmetrical configuration along the length of and to one side of a given surface to be camouflaged on said building, attaching an elongated edge of a sheet-like means to said support bar said edge having the same nonlinear, nonsymmetrical configuration as said support bar, said sheet-like means also having a topside including artificial garnish supported thereon and a bottomside, positioning said sheet-like means over said given surface with its top garnish supporting side exposed to the surrounding and diverting the exhaust gases of a jet when the jet is located within said hangar and starts up therein, said gases being diverted along an underground passageway to a remote subterranean location a substantial distance from said hangar in a way which prevents the heat from said gases within a substantial section of said passageway from being detected at ground level.

* * * * *